US006112413A

United States Patent [19]

Frakes et al.

[11] Patent Number: 6,112,413

[45] Date of Patent: Sep. 5, 2000

[54] SHINGLE SEVERING DEVICE

[76] Inventors: Thomas Wayne Frakes, 3515 Crestview, St. Joseph, Mich. 49085; Thomas Earl Frakes, 5526 W. Hiawatha La., Stevensville, Mich. 49127

[21] Appl. No.: 09/264,332

[22] Filed: Mar. 8, 1999

[51] Int. Cl.[7] ..... B26D 7/01; B26B 13/06

[52] U.S. Cl. ..... 30/229; 83/607; 83/920

[58] Field of Search ..... 30/229, 230, 178; 83/607, 920

[56] References Cited

U.S. PATENT DOCUMENTS 4,425,710 1/1984 Mason et al. ..... 30/229

5,052,256 10/1991 Morrissey ..... 83/920 X 5,249,495 10/1993 Renk ..... 83/607 X

*Primary Examiner*—Douglas D. Watts

*Attorney, Agent, or Firm*—Flynn, Thiel, Boutell & Tanis, P.C.

[57] ABSTRACT

A shingle severing device includes a cutter pivotably secured to a work carrier. The work carrier mounts spaced blades and the cutter mounts spaced blades alignable with the work carrier blades. A shingle support and fences locate a conventional shingle. With an elongate roofing shingle placed on the support, the cutter and work carrier are moved from an open position to a closed position to sever the shingle along two spaced lines. A stop prevents overtravel beyond the closed position. The severing removes from the roofing shingle a ridge shingle with a trapezoid shaped end.

13 Claims, 11 Drawing Sheets

SHINGLE SEVERING DEVICE

FIELD OF THE INVENTION

This invention relates to a shingle severing device for cutting a conventional roofing shingle into shape for use as a ridge shingle on the ridge of a building roof.

BACKGROUND OF THE INVENTION

It is common prior practice to use a conventional, hand held knife, at the job site, to manually cut a conventional asphalt roofing shingle (such as a so-called "three-in-one" shingle) into one or more ridge shingles for placement at the peak or ridge, of a roof. Such practice requires two manual cuts, one after the other, to form each ridge shingle. Such practice tends to produce ridge shingles relatively slowly. Such hand knife cutting tends to be inaccurate and produce non-uniformily sized and shaped ridge shingles. Further, hand knife blades dull quickly and require frequent replacement or sharpening. Manually cutting shingles with a hand knife requires substantial manual force, and tires the user after cutting relatively few shingles. Such hand knife cutting risks injury to the knife user and to material adjacent the shingle being cut.

Accordingly, it is an object of this invention to provide an improved portable device for cutting conventional shingles into ridge shingles, while avoiding one or more of the above discussed disadvantages of the prior practice.

SUMMARY OF THE INVENTION

In one embodiment according to the invention, a shingle severing device includes a work carrier having at least one blade, and a cutter movably mounted with respect to the work carrier and having at least one blade thereon. The cutter blade and work carrier blade are aligned to cut a shingle located on the work carrier, when the cutter and work carrier are brought together.

Further objects and purposes of the invention will be apparent to persons acquainted with the apparatus of this general type upon reading the following description and inspecting the accompanying drawings.

Figure 1:
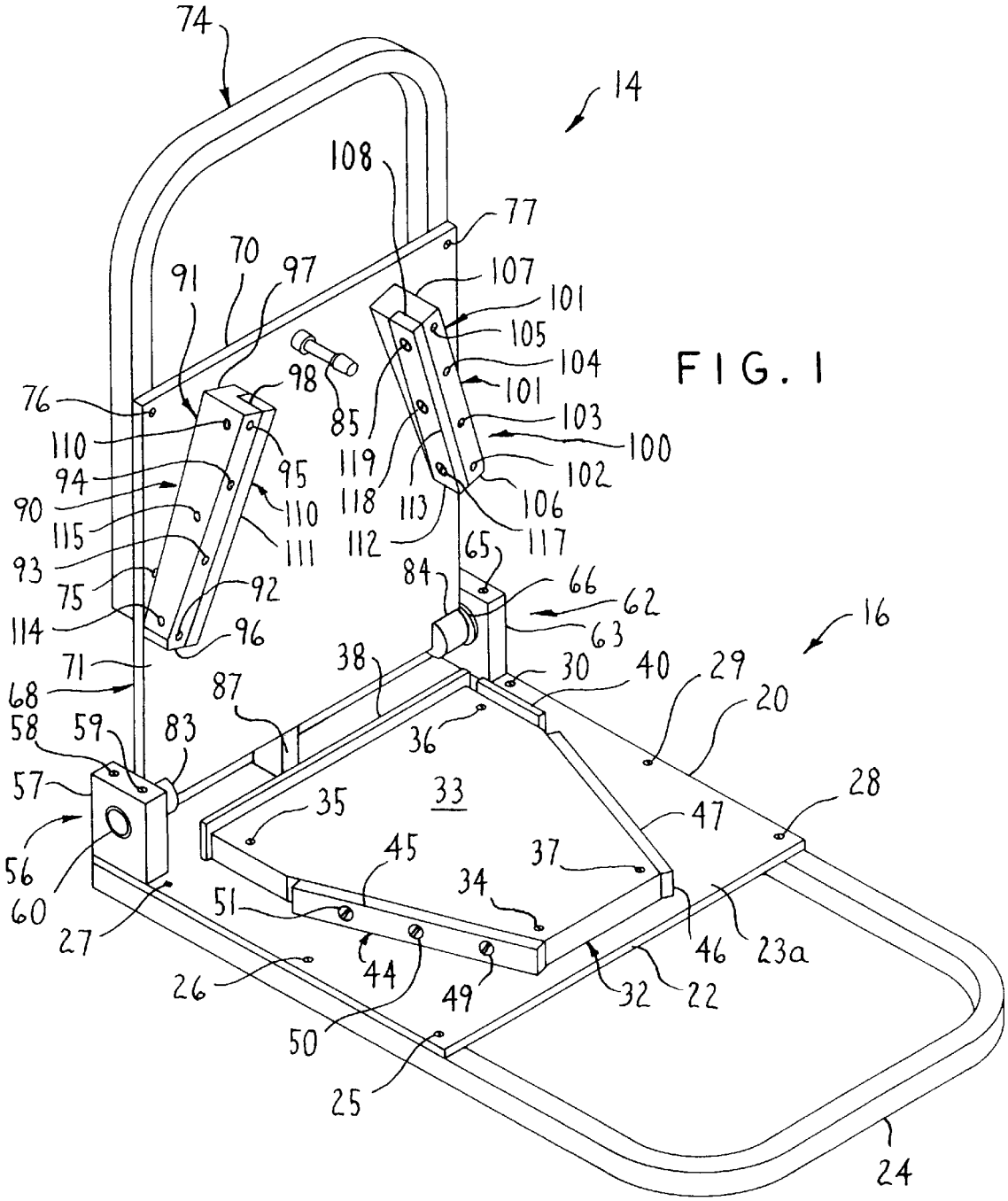
FIG. 1 is a pictorial view of a shingle severing device according to the present invention, in an open position.

Certain terminology will be used in the following description for convenience and reference only, and will not be limiting. For example, the words "upwardly", "downwardly", "rightwardly" and "leftwardly" will refer to directions in the drawings to which reference is made. The words "front" and "rear" will refer to left and right ends of the device in FIG. 8. The words "inwardly" and "outwardly" will refer to directions toward and away from, respectively, the geometric center of the disclosed shingle severing device and designated parts thereof. The word "centered" means the geometric center of the shingle severing device and designated parts thereof. Such terminology will include the words specifically mentioned, derivatives thereof, and words of similar import.

DETAILED DESCRIPTION

FIGS. 1–11 show a shingle severing device 14 embodying the present invention. The device 11 includes a work carrier 16 and a cutter 18 relatively movable for severing ridge shingles from a conventional roofing shingle.

WORK CARRIER

The work carrier 16 (FIGS. 5 and 7) includes a base 20, preferably formed as a rectangular plate having a rear edge 21, a front edge 22, opposed side edges 22*a*, 22*b*, an inner surface 23*a* and an outer surface 23*b*. A generally U-shaped handle 24 has a bight portion 24*a* spaced forward from the base front edge 22 and substantially parallel legs 24*b* extending rearward therefrom, along the outer surface 23*b* adjacent the side edges 22*a*, 22*b* of the base 20. The handle legs 24*b* are fixed to the base 20 by any convenient means, such as fasteners (here screws) 25–30 or welding, or by other suitable means. The handle 24 is preferably a hollow tube here, for example, of rectangular cross-section.

A shingle support 32 (FIG. 5), preferably formed as a plate, includes a relatively short, rectangular, rear portion and a longer, generally trapezoidal, front portion. The side edges of the front portion converge forwardly (to the right in FIG. 5). The shingle support 32 is smaller longitudinally (from front to rear) and widthwise (from side to side) than the base 20 and is centered thereon, so as to be spaced from the edges 21, 22, 22*a*, 22*b* thereof. The shingle support 32 is fixed to the inner surface 23A of the base 20 by any convenient means, such as fasteners (here screws) 34–37, welding or the like. The shingle support 32 has a generally smooth top surface 33 for receiving a roofing shingle to be cut.

A back fence 38 (FIG. 5), preferably a rectangular plate, is fixed to the rear edge of the shingle support 32 by any convenient means, such as fasteners (here for example, screws) 38*a*, 38*b* (FIG. 10), welding, or the like. The back fence preferably extends the full width of the shingle support 32.

A side fence 40 (FIG. 5) is fixed to and extends along one side (conveniently the right side as here shown) of the rectangular rear portion of the shingle support 32 by any convenient means, such as fasteners (e.g. screws) 41, 42 (FIG. 7), welding or the like. Side fence 40 can be fixed on either side of the shingle support 32 to allow either left handed or right handed shingle loading. The side fence 40 is preferably a rectangular plate and is shorter than the back fence 38.

The back and side fences 38 and 40 are preferably of the same height and extend above the top of the shingle support 32 by at least, and preferably somewhat more than, the thickness of a conventional roofing shingle to be cut. While it is convenient to fix the fences 38 and 40 to the edges of the shingle support 32, it is contemplated that the fences could be instead fixed to the inner surface of the base 20 adjacent the corresponding edges of the shingle support 32.

Blades 44 and 46 (FIG. 5) extend along and are removably fixed to the converging side edges of the forward portion of the shingle support 32. The blades 44 and 46 are preferably flush with the top surface 33 of the shingle support 32. The blades 44 and 46 have respective length edges 45 and 47 spaced from both the shingle support 32 and base 20, namely the upper outboard length edges in FIG. 5. The length edges 45 and 47 function as cutting, and more particularly shearing edges as hereafter described. The blades 44 and 46 are preferably identical and formed as elongate rectilinear bars. Each such bar thus includes four sides joined at substantially right angle corners respectively defining four length edges. The blades 44, 46 thus advantageously are releasably fixed (FIGS. 5 and 7) to the opposed shingle support edges, preferably by screws 49–54 distributed symmetrically along the length of the blades 44, 46. Thus, release of the screws 49–51, 52–54 permits repositioning of the corresponding blade 44, 46 to expose a new length edge 45, 47 for cutting or shearing. Since each blade 44, 46 thus has four alternatively usable cutting edges, a given blade 44, 46 can be used four times as long as is required to dull a given length edge 45, 47 to uselessness.

CUTTER

The cutter 18 (FIGS. 3, 4 and 6) includes a base 68, preferably formed as a rectangular plate, having a rear edge 69, a front edge 70, side edges 70*a*, 70*b*, an inner surface 71 and an outer surface 72.

A generally U-shaped handle 74 has a bight portion 74*a* forwardly spaced from the front edge of 70 and legs 74*b* extending rearward along the side edges of the cutter base 68 in contact with the outer surface 72. The handle 74 is preferably a hollow tube, here for example of rectangular cross section, similar to the work carrier handle 24. The handle 74 is fixed to the cutter base 68 by any convenient means, such as fasteners (here screws) 75–78, welding or the like.

Figure 3:
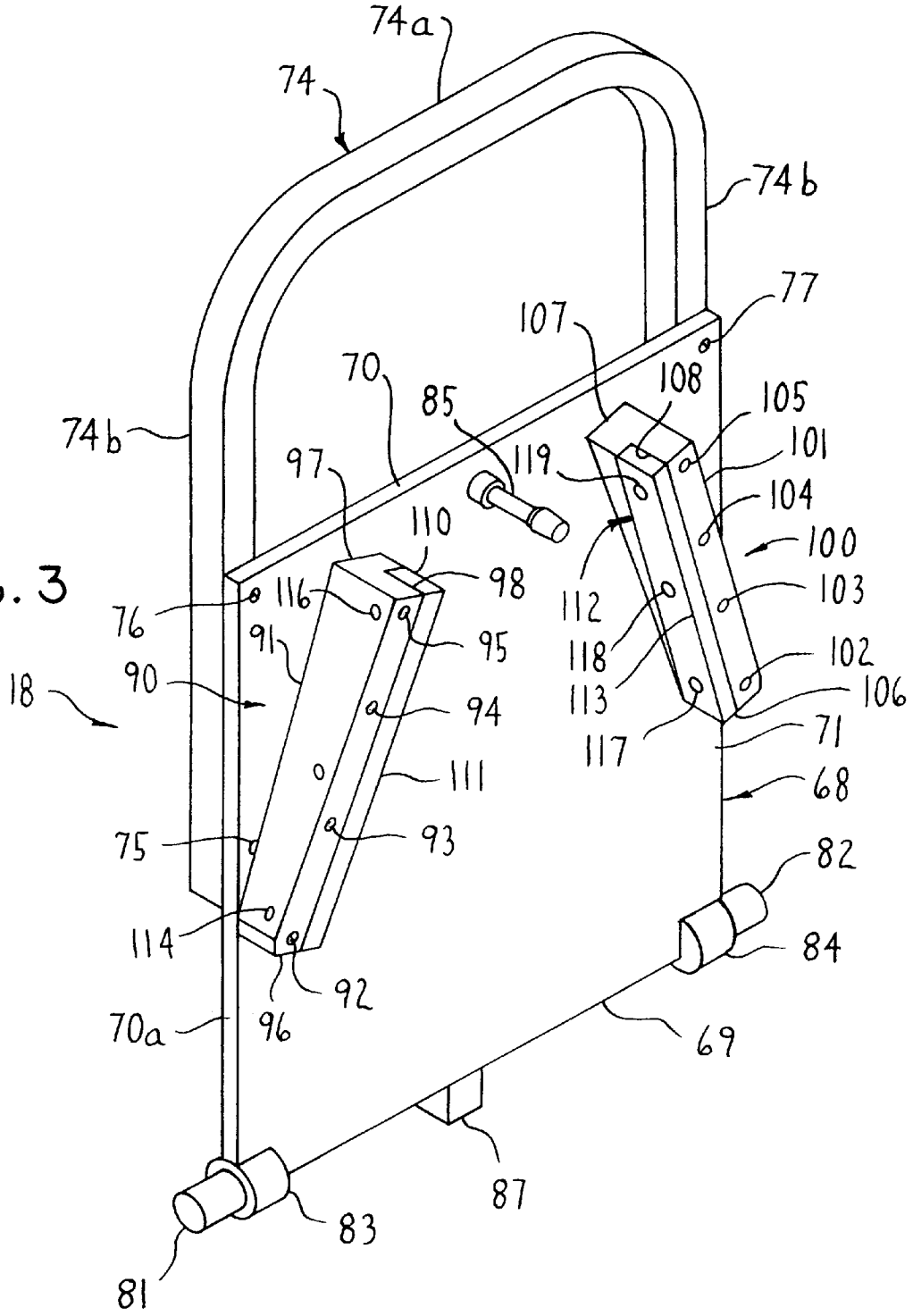
FIG. 3 is a pictorial view of the cutter of FIG. 1.

First and second blade units 90 and 100 (FIG. 4) are fixed to the inner side 71 of the cutter base 68. The blade units 90 and 100 are preferably mirror images of each other. The blade units 90, 100 include respective blade supports 91, 101 respectively fixed to the cutter base 68 by fasteners (preferably screws) 92–95, 102–105, welding or the like. The blade supports 91, 101 each taper lengthwise from front to rear, in a wedge-like manner, such that the support front end 96, 106 protrudes further from the base 68 than the rear end 97, 107. The blade supports 91, 101 each are generally of L-shaped cross section (as seen in FIG. 3), having substantially rectangular cross section notches 98, 108 extending lengthwise thereof. Such notches 98, 108 face each other and are remote from the base 68.

The blade units 90 and 100 further include respective, preferably identical blades 110 and 112, which here fill the respective longitudinal notches 98, 108 in the respective blade supports 91 and 101 and extend the length thereof. The cutter blades 110 and 112 are preferably of rectangular cross section and are removably fixed to the blade supports 91 and 101 respectively by conventional fasteners (preferably screws) 114–116 and 117–119 which extend through the blades into the adjacent sides of the corresponding blade supports. The blades 110 and 112 have respective length edges 111 and 113 opposed to each other and remote from the base 68 and usable for cutting or shearing a roofing shingle. Like the work carrier blades 44 and 46, the cutter blades 110 and 112 have their screws 114–116 and 117–119 distributed symmetrically along the length thereof, and so can be re-oriented on their respective supports 91 and 101, to alternately expose a new, sharp length edge for cutting or shearing a roofing shingle. This extends usable life of the blades 110 and 112 by a factor of four, as with the work carrier blades 44 and 46.

Figure 4:
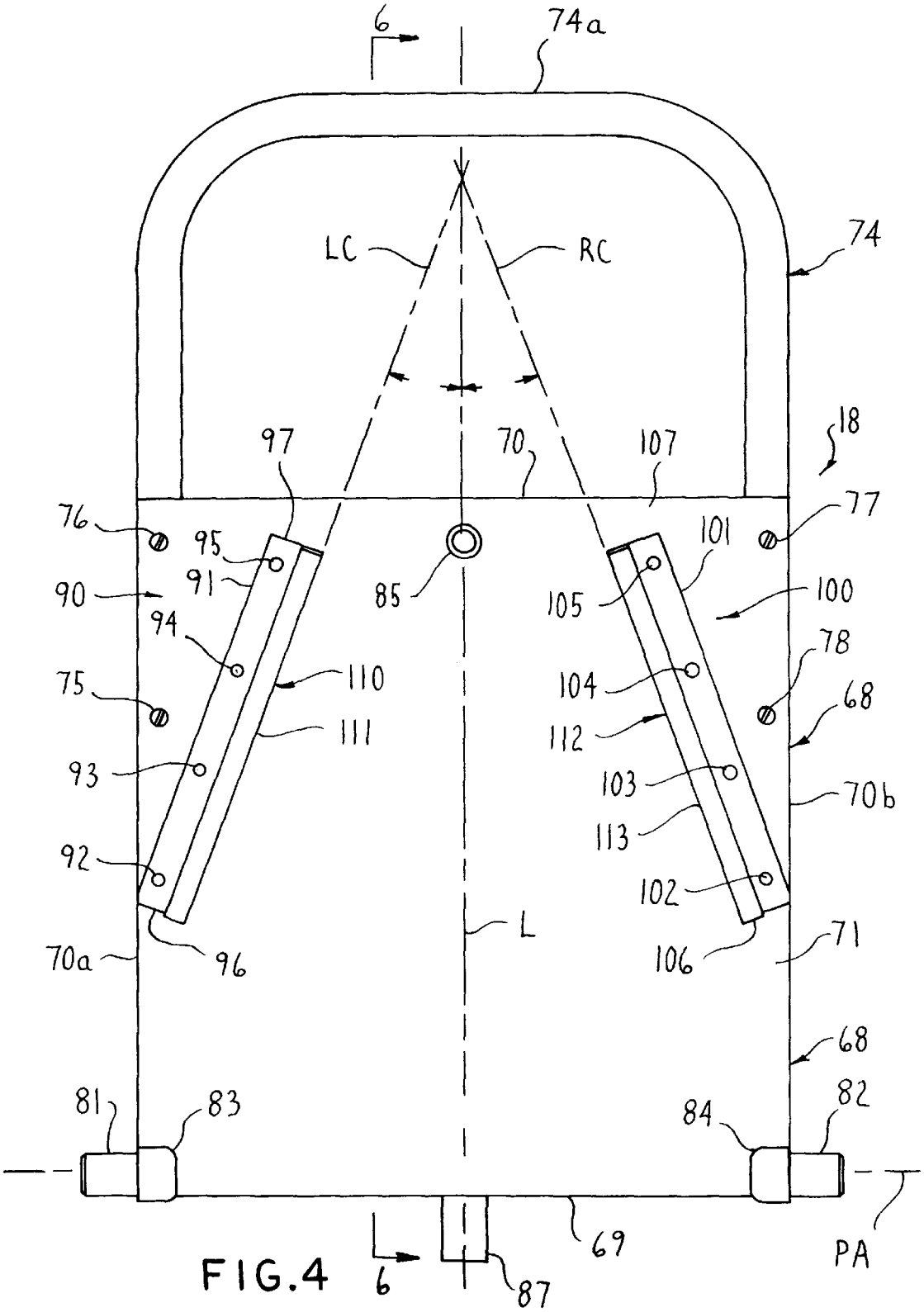
FIG. 4 is an interior elevational view of the cutter of FIG. 3.

As seen in FIG. 4, the blade units 90 and 100 converge forwardly (upwardly in FIG. 4) along the inner surface 71 of the cutter base 68.

In the preferred embodiment shown, the work carrier 16 and cutter 18 are supported movably with respect to each other by pivoting. The work carrier 16 and cutter 18 are thus here shown as pivotably interconnected, with shaft elements 81, 82 on one pivoting in bearing blocks 57, 63 on the other. If desired, the bearing blocks 57, 63 may be on the cutter 18 and the shaft elements 81, 82 may be on the work carrier 14, but the preferred embodiment reverses that arrangement.

In the preferred embodiment shown, pivot units 56 and 62 (FIG. 5) are fixed to work carrier base 20 by any convenient means such as fasteners (here screws) 58–59 and 64–65, welding or the like. The pivot units 56 and 62 protrude inward from the rear corners of the inner surface 23*a* of the work carrier base 20. Coaxial holes in the bearing blocks 57 and 63 are lined with corresponding coaxial shaft bushings 60 and 66, the axis of which parallels the base rear edge 21 and back fence 38. Corresponding shaft elements 81 and 82 (FIG. 3) extend from the cutter base 68 adjacent the back edge 69 and laterally beyond the side edges 70*a*, 70*b* of the cutter base 68 on a common axis PA (hereinafter the pivot axis) parallel to the cutter base back edge 69. The shaft elements 81 and 82 may be fixed to the cutter base 68 by any convenient means. Here for example, cup-like housings 83, 84 are fixed as by welding to the rear corners of the cutter base 68 and open sidewardly of the cutter base 68 to receive the shaft elements 81 and 82, which may be fixed therein by any convenient means such as welding. The shaft elements 81 and 82 are sized and spaced for snug pivotable reception in the shaft bushings 60 and 66 of the work carrier 16.

A closure stop 85 (FIG. 3) protrudes from the cutter base inner surface 71 adjacent the front edge 70 in centered, spaced relation between the front ends 97, 107 of the blade units 90, 100. The closure stop 85 comprises an elongate pin with a resilient cap at the free end thereof and protrudes from the cutter base surface 71 farther than the blade units 90 and 100. The closure stop 85 is fixed to the cutter base 68 by any convenient means here, for example, a screw 86 (FIG. 2) extending through the thickness of the cutter base 68 and threaded into the adjacent end of the closure stop 85.

An opening stop 87 (FIGS. 2 and 4) is fixed to the cutter base 68 adjacent the back edge 69 thereof and extends beyond such back edge. The opening stop 87 may be shaped as desired, but is here shown as a rectilinear block. The opening stop 87 is fixed in preferably substantially centered relation between the pivot units 56 and 62 by any convenient means, such as fasteners (here screws) 88, 89 welding or the like.

Figure 5:
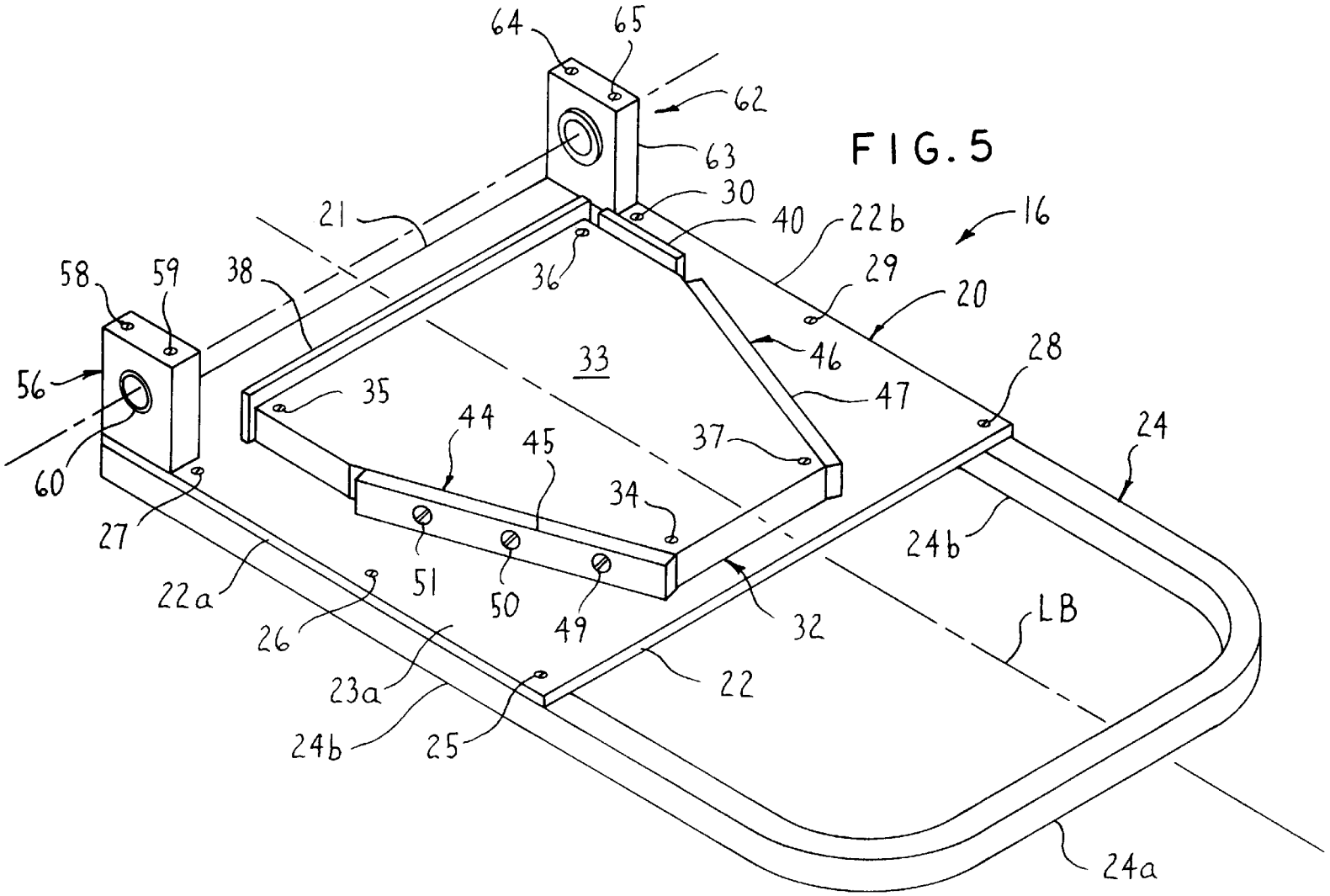
FIG. 5 is a pictorial view of the work carrier of FIG. 1.
Figure 6:
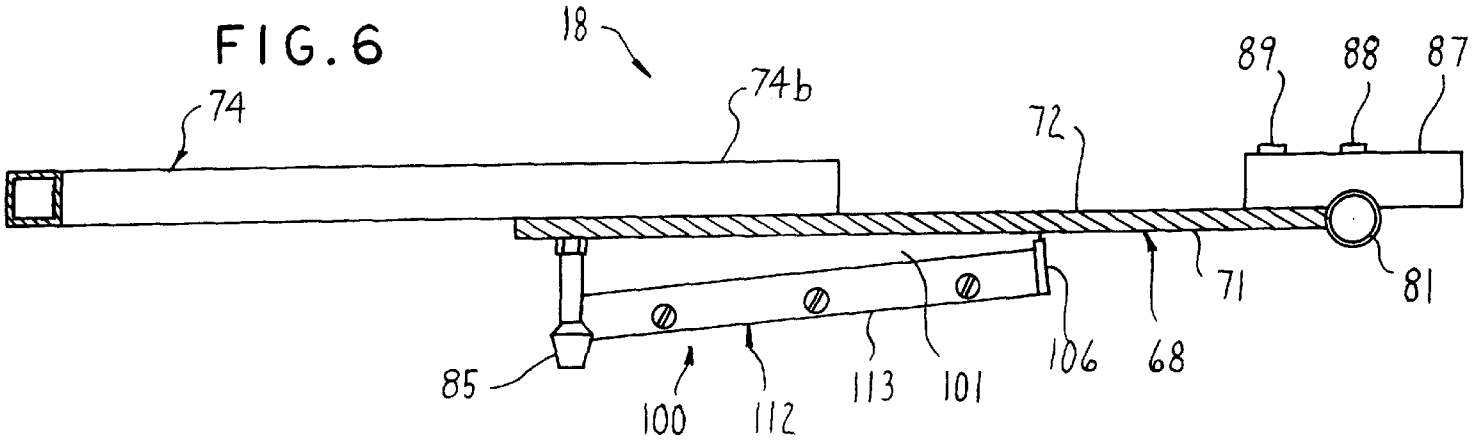
FIG. 6 is an enlarged cross sectional view substantially taken on the line 6—6 of FIG. 4.
Figure 7:
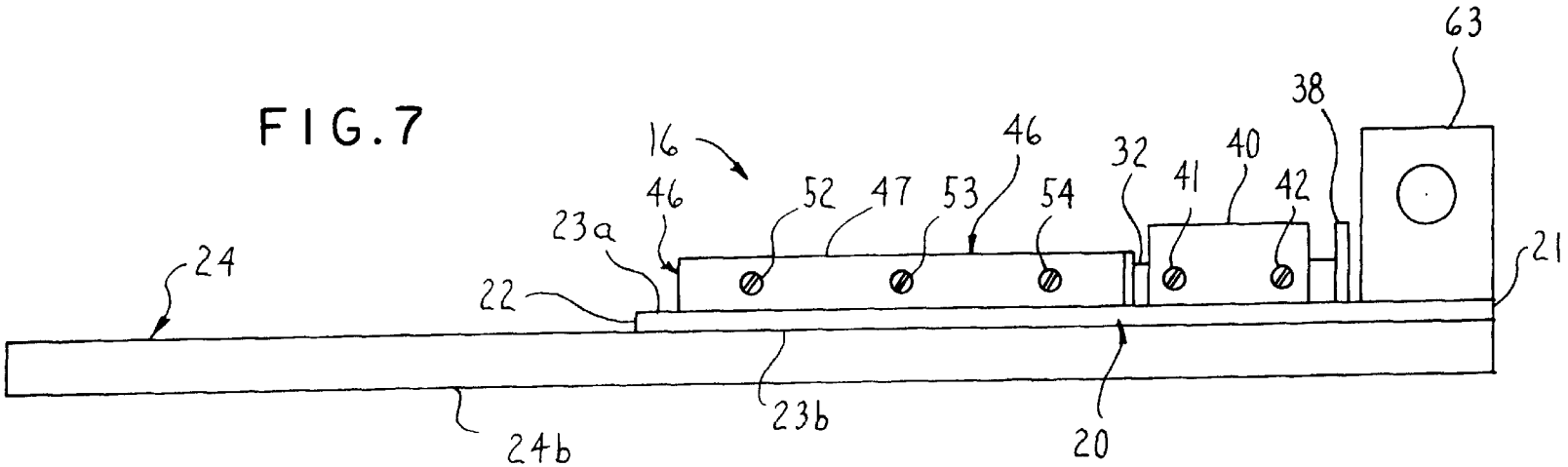
FIG. 7 is an enlarged side view of the FIG. 5 work carrier, taken substantially from the right side of FIG. 5.

The work carrier 16 and cutter 18 have respective longitudinal central axes LB and L (FIGS. 5 and 4, respectively). As seen in FIG. 4, the left and right cutter blades 110 and 112 have opposed inboard faces (which carry the longitudinal cutting length edges 111 and 113) which define forwardly (upwardly in FIG. 4) convergent planes LC and RC. The planes LC and RC intersect at, and define substantially equal acute angles A and B with the longitudinal center line L. The angles A and B each preferably lie in the range of 5–45° (here shown as about 220). The work carrier blades 44 and 46 make substantially the same angle with the work carrier base central longitudinal axis LB (FIG. 5).

Figure 10:
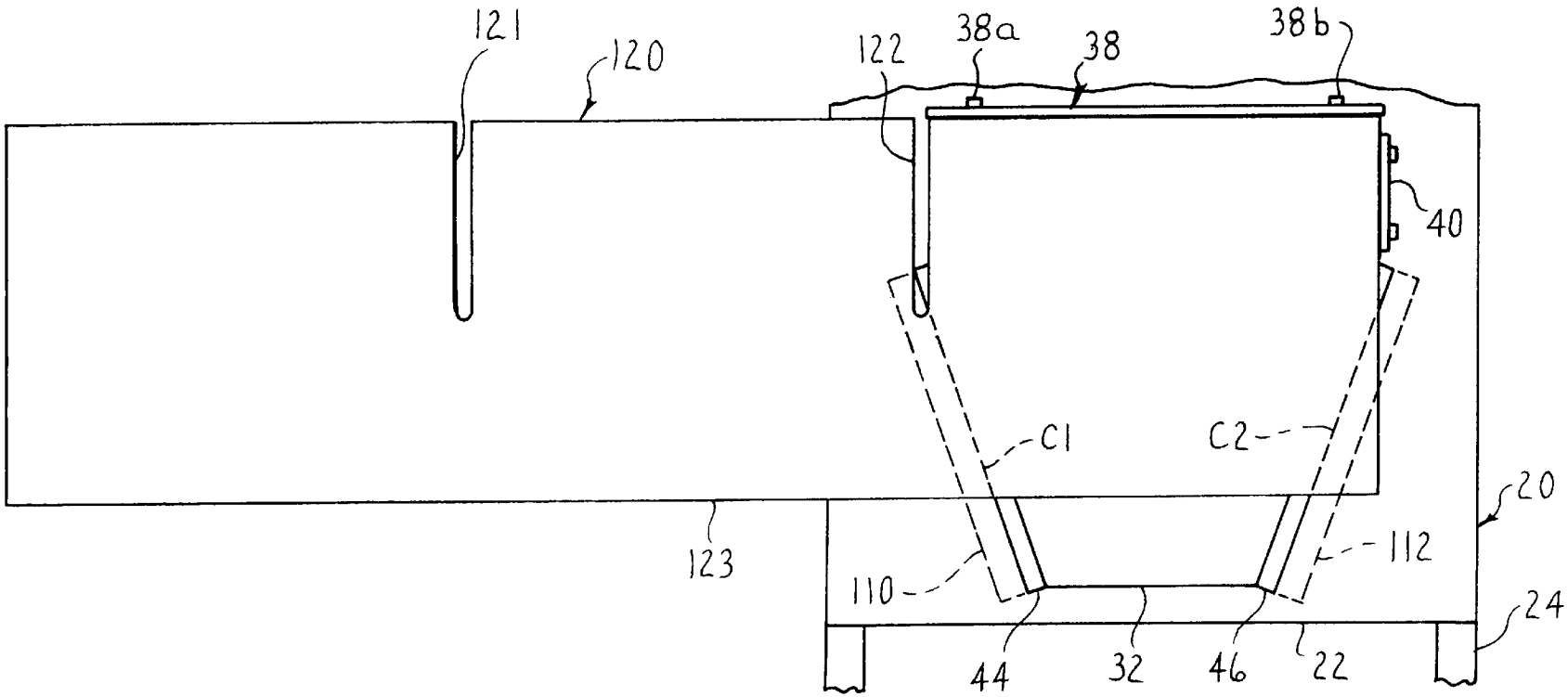
FIG. 10 is a fragmentary top (inside) view of the FIG. 5 work carrier with a shingle thereon for cutting, and showing in phantom lines the location of the cutter blades in the closed position.
Figure 11:
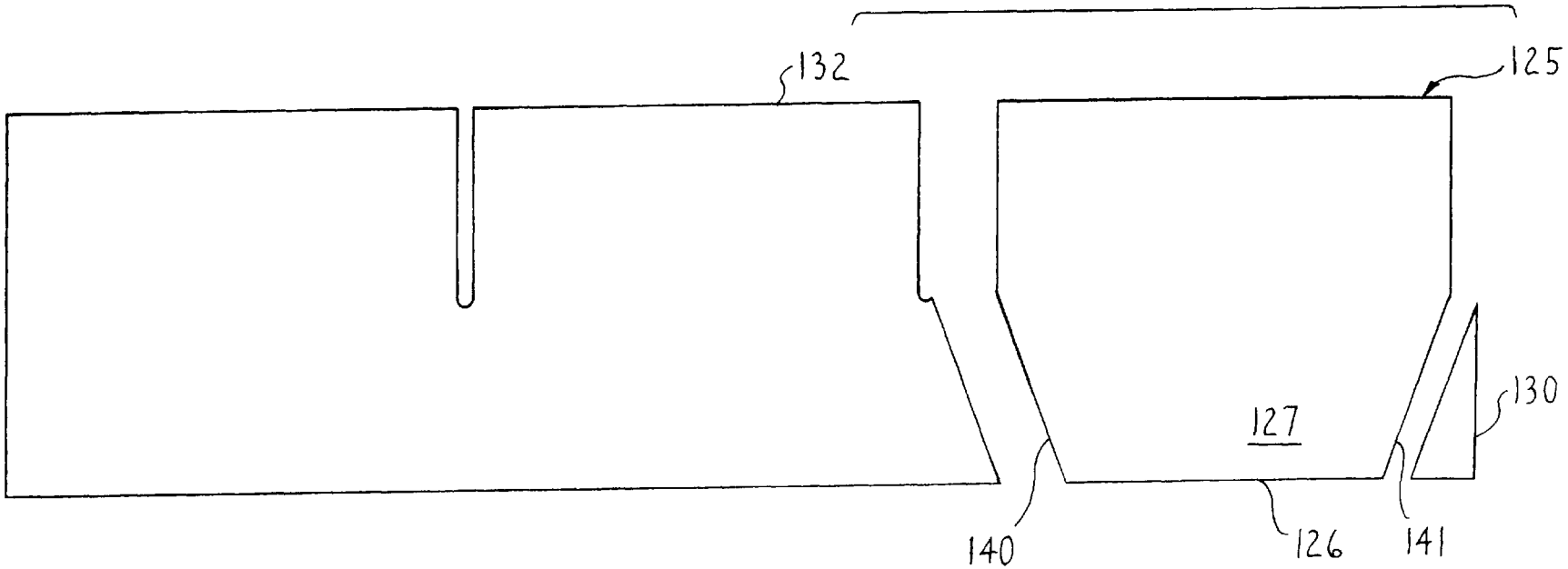
FIG. 11 is a top view of portions of the shingle of FIG. 10 after severing, and including a ridge shingle.

The work carrier blades 44 and 46 (FIG. 5) and the cutter blades 110 and 112 are spaced from each other and from the pivot axis PA and are oriented with respect to each other in respective planes parallel to their respective bases so that the cutter blades 110 and 112 closely flank the work carrier blades 44 and 46 during shingle cutting, as shown schematically in FIG. 10. The clearance between the blades 44 and 110 and the blades 46 and 112 is large enough to avoid interference as the cutter 18 pivots from its FIG. 1 position to its FIG. 2 position, but small enough to allow each coacting blade pair 44, 110 and 46, 112 to perform a shearing cut on a roofing shingle.

The major components of device 14 are preferably constructed of metal, desirably a light weight metal, such as aluminum, for ease in carrying from place to place. The blades are preferably of a harder metal, capable of retaining a cutting edge, such as a hardened steel.

The components defining the work carrier 16 and the cutter 18 are assembled as generally indicated above, but leaving one of the bearing blocks (e.g. bearing block 57) detached from the work carrier 16. The work carrier 16 and cutter 18 are then aligned along their shared pivot axis PA (FIG. 2) with the shaft element 82 installed in the bearing block 63. The bearing block is then slid onto the shaft element 81 and then fixed to the work carrier base 20. The cutter 18 and the work carrier 16 are then rotatable with respect to each other about their shared pivot axis PA in FIG. 4.

OPERATION

In the open position (FIG. 1) of the device 14, the opening stop 87 abuts the work carrier top surface 23*a* (FIG. 5), and prevents the cutter 18 from opening beyond about a right angle with respect to the work carrier 16.

A conventional roofing shingle particularly a "three-in-one" shingle 120 (FIG. 10) has a pair of slots 121, 122 spaced along one length edge. The shingle 120 is placed granules down on the surface 33 of the shingle support 32 with its slots 121, 122 opening rearwardly toward the fence 38. The user then abuts the slotted edge and right end (in FIG. 10) of the shingle 120 against the back fence 38 and the side fence 40, respectively, of the work carrier 16. The fences 38, 40 precisely locate the shingle 120 with respect to the work carrier blades 44, 46 for cutting. An end of the work carrier blade 44 is visible below the slot 122 of the shingle 120 when the shingle is properly located on the shingle support 32 as shown in FIG. 10.

Figure 8:
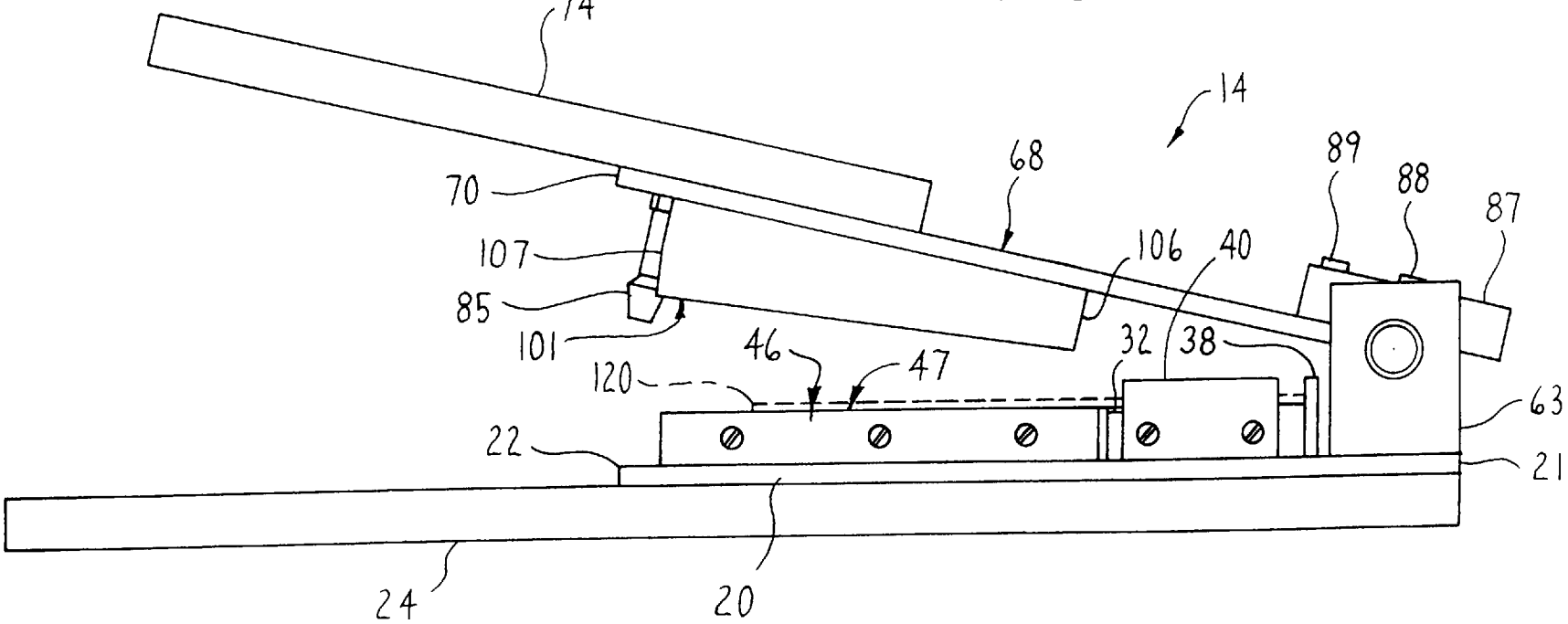
FIG. 8 is an enlarged side view of the FIG. 1 shingle severing device in a partly open position, prior to cutting, and taken from the right side in FIG. 1.

Then the cutter 18 is lowered by the user from its open FIG. 1 position toward the shingle 120 on the work carrier 20 toward and through the FIG. 8 position (the shingle 120 being shown in broken line).

Figure 9:
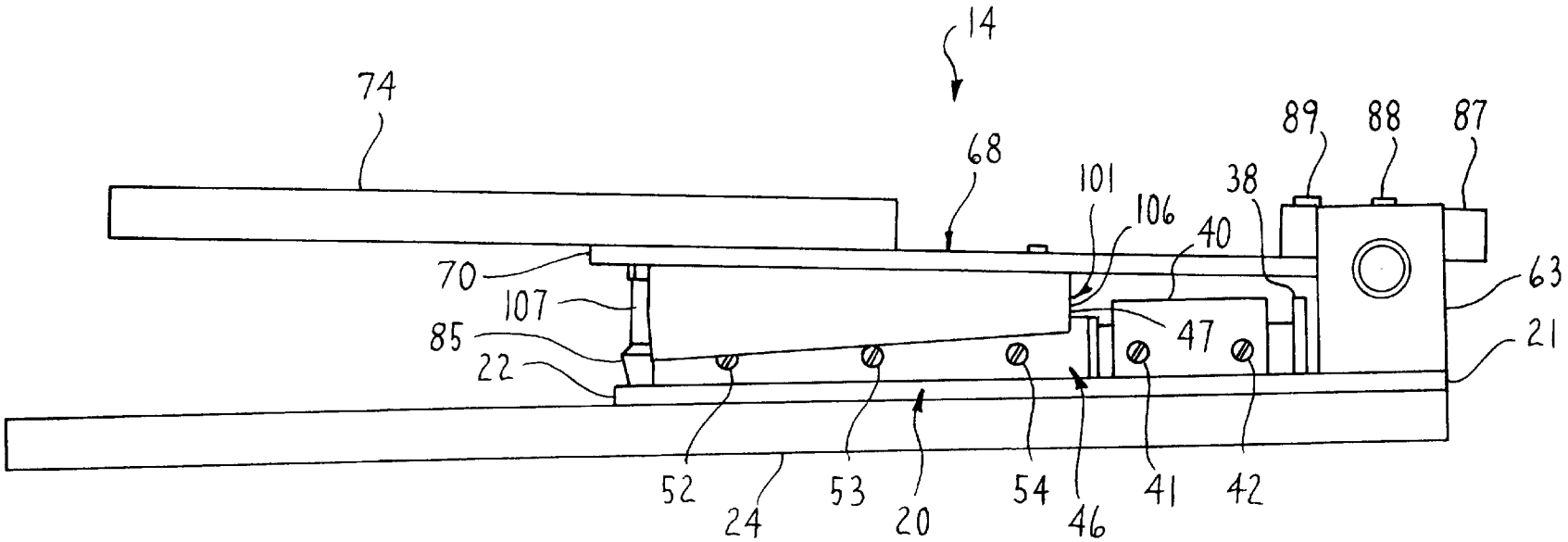
FIG. 9 is a view similar to FIG. 8, but with the shingle severing device in a closed position, after cutting.

As the cutter blade units 90, 100 approach the work carrier 16, in the transition from FIG. 8 to FIG. 9, the cutting length edges 111, 113 of the cutter blades 110, 112 drop closely past the respective cutting length edges 45, 47 of the work carrier blades 44, 46, in a shearing manner, thus making cuts C1 and C2 (FIG. 10) in the three-in-one shingle 120.

In the cutter 20 movement from FIG. 8 to FIG. 9, the forwardly diverging wedge shape of the blade units 90 and 100 (FIG. 1) causes the cutter blades 110 and 112 to begin cutting the shingle 120 at its front facing edge 123 (FIG. 10). Cutting advances rearward toward the rear fence 38 and to the slot 122. Cutting thus advances from the front ends of the blades 44, 46, 110 and 112 (FIG. 1), along the cutting length edges 45, 47, 111 and 113, toward the rear ends of the blades 44, 46, 110 and 112. Such severing from front to rear urges the shingle 120 against the fences 38, 40 particularly the rear fence 38, during severing of the shingle. Thus, the cutting operation itself helps hold the shingle in proper position against the fences 38, 40, and so avoids risk of nonuniform or unevenly cut ridge shingles 125.

Figure 2:
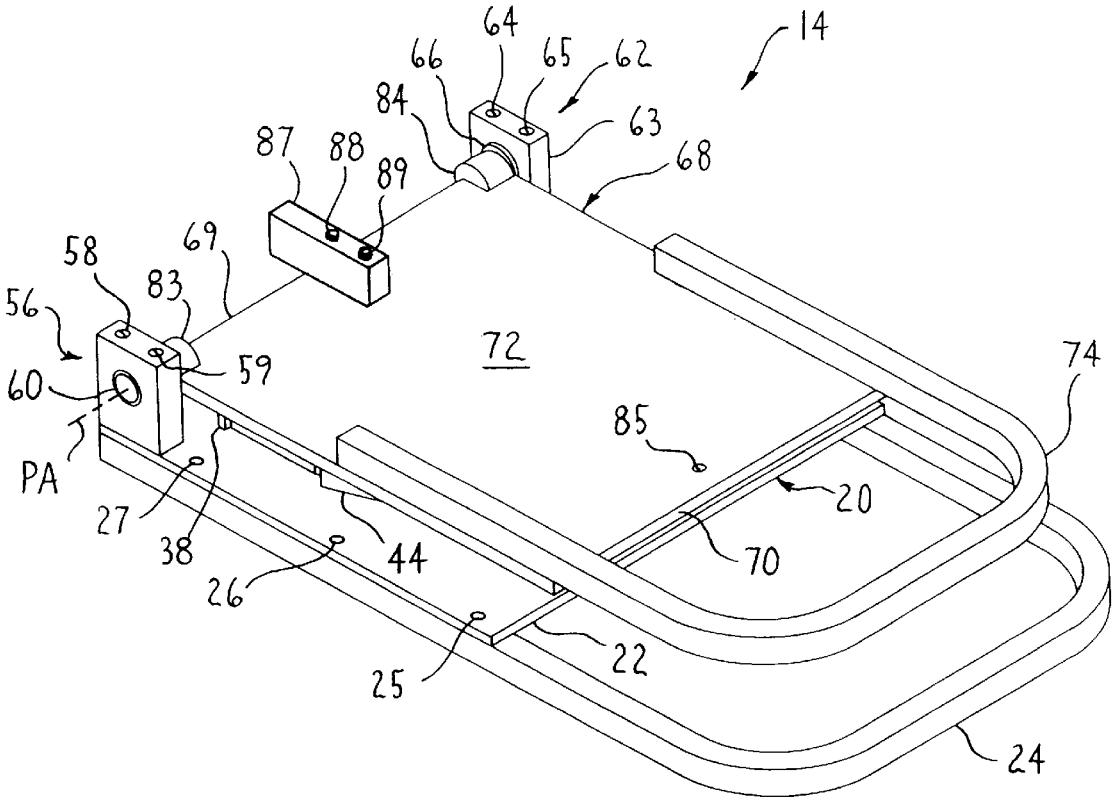
FIG. 2 is a pictorial view of the FIG. 1 shingle severing device in a closed position.

After the cuts C1 and C2 (FIG. 10) are completed, the closure stop 85 contacts the inner surface 23*a* of the work carrier base 20, stops movement of the cutter 18 at the FIG. 2 closed position and prevents overtravel which could contact the cutter blades 110, 112 with the work carrier base 20 and damage same.

The cuts C1 and C2 (FIG. 10) sever, from the right end of the three-in-one roofing shingle, a ridge shingle 125 (FIG. 11) having a rear rectangular exposed end and a front, tapered trapezoidally shaped hidden end portion 127. The ridge shingle 125 thus narrows toward its front edge 126 along backing portion 127 thereof. The cuts C1 and C2 (FIG. 10) form convergent ridge shingle edges 140 and 141 (FIG. 11) which begin on the exposed portion of the shingle and extend to the front edge 126. Therefore, such ridge shingles 125 can be overlapped along a roof ridge without exposing the hidden end portions 127. Shingle piece 130 is waste material and is discarded.

After the device 14 is opened and the ridge shingle 125 is removed, the shingle remainder piece 132 is moved rightwardly (FIG. 10) to abut the side fence 40. The cutting operation is repeated to form a second ridge shingle. A further cutting operation repeat forms a third ridge shingle. Thus, three ridge shingles can be formed from a conventional three-in-one shingle.

The handles 24, 74 are convenient for carrying the device 14 to a point of use, add leverage in closing the device 14 for cutting, and ease opening of the closed device.

MODIFICATION

Figure 12:
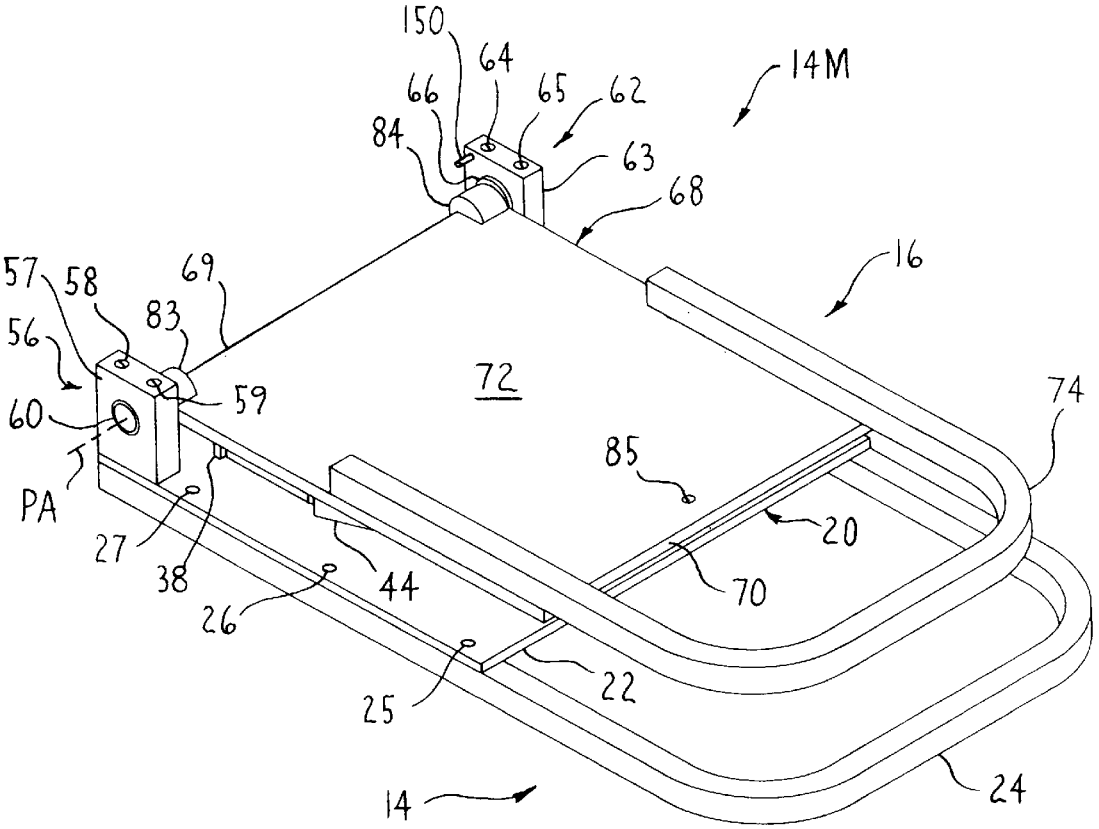
FIG. 12 is a view similar to FIG. 2 but shows a modified opening stop.

A modified shingle severing device 14M (FIG. 12) is preferably similar to the device 14 (FIG. 2) except for deleting the opening stop 87 (FIG. 2) and instead adding a protrusion (preferably a pin, such as a conventional spring roll pin) 150 (FIG. 12) in the pivoting path of the cutter base 68. In the embodiment shown the pin 150 protrudes laterally inward from the upper rear corner portion of the inboard face of the bearing block 63 near the cylindrical housing 84. Conveniently the pin may be force fitted fixedly in a hole (not shown) drilled in the bearing block 63. Thus, opening pivotal movement of the cutter 16 is limited to about a right angle by collision of the cutter base surface 72 with the pin 150.

Preferably, a second pin (not shown), similar to and coaxially opposing the pin 150, similarly protrudes from the inboard face of the bearing block 57, such that the opening cutter 16 simultaneously collides, along both of its side edge portions, with such pins to stop its opening movement.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A device for severing, from a conventional elongate roof shingle a shorter ridge shingle, said device comprising:

a) a work carrier comprising:

a base; and a shingle support upstanding from said base, said shingle support having opposite sides and a top adapted to receive a portion of a conventional shingle, said shingle support at said sides being narrower than a ridge shingle to be severed; and first and second spaced carrier blades flanking said opposite sides of said shingle support, said carrier blades each having a cutting length edge; and b) a cutter secured to said work carrier for relative movement between an open position and a closed position, said cutter comprising:

a base; and first and second spaced cutter blades mounted on said cutter base, said cutter blades in said closed position (1) flanking said carrier blades and (2) opposing the face of said work carrier base, said cutter blades each having a cutting length edge, said cutter blade cutting length edges being aligned with respective ones of said work carrier blade cutting length edges with said cutter and work carrier adjacent said closed position, such that relative movement of said cutter and work carrier toward said closed position enables said respective cutter blades and work carrier blades to shear a ridge shingle from a conventional elongate shingle.

2. The device of claim 1, wherein a said cutter blade is part of a corresponding blade unit secured to said cutter base, a said cutter blade comprising a bar having inner and outer length edges, said cutter blade bar being supported on said blade unit such that said inner length edge of said cutter blade bar defines the cutting length edge of said cutter blade.

3. The device of claim 1, wherein a said work carrier blade comprises a bar having inner and outer length edges and being secured to said shingle support sides, said work carrier blade bar being supported on said work carrier blade unit such that said outer length edge defines the cutting edge of said work carrier blade.

4. The apparatus of claim 1, wherein ones of said blades each comprise a replaceable bar, a said bar being of rectangular cross-section and having four sharp length edges alternately presentable for cutting, the latter said bar being repositionable with respect to its corresponding said base by rotation about its length axis, when one of its said four length edges becomes dull, to present another said sharp length edge for cutting.

5. The device of claim 1, including a fence fixed with respect to said shingle support to locate an edge of a shingle, said cutter and said work carrier having a cut starting position intermediate said open and closed positions, a said cutter blade and a corresponding said work carrier blade having respective second ends in shingle cutting engagement and having respective first ends spaced from each other in said cut starting position, said fence being further from said second blade ends than said first blade ends, such that the last mentioned said cutter blade and work carrier blade coact to (1) positively block shingle displacement away from said fence and (2) tend to urge a shingle against said fence, to thereby positively locate a shingle on said work carrier for accurate severing.

6. The device of claim 1, wherein said cutter and said work carrier are rotatably secured to each other adjacent first ends of said cutter and said work carrier, a given said cutter blade length edge being spaced from said cutter base, said given cutter blade length edge having a first end positioned adjacent said first end of said cutter base and a second end remote from said first end of said cutter base, said given cutter blade length edge being spaced from said cutter base less at its said first end than at its said second end.

7. The device of claim 1, including a closure stop extending from one of said carrier base and cutter base toward the other, said closure stop spacing said cutter blades and work carrier base at said closed position and thus preventing damaging contact of said cutter blades with said work carrier base.

8. The device of claim 1, wherein said work carrier and said cutter (1) have rear portions operatively coupled for said relative movement and (2) respective forward protruding handles, said handles having (a) a together position holding said device in its said closed position and facilitating transporting of said device and (b) a range of separated positions resulting in relative cutter and work carrier positions between said open and closed positions.

9. The device of claim 1 including an opening stop interposed between said work carrier and cutter base and preventing said cutter and said work carrier from moving away from each other beyond said open position.

10. A device for severing a shorter ridge shingle from a conventional elongate roof shingle, said device comprising:

a shingle support for supporting a conventional shingle;

a first elongate shearing bar having a shearing edge extending lengthwise thereof, said first bar being releasably fixed with respect to said shingle support with its said shearing edge located for shingle shearing;

a movable base mounted for movement toward and away from said shingle support;

a second elongate shearing bar having a shearing edge extending lengthwise thereof, said second bar being releasably fixed with respect to said movable base with its said shearing edge located for movement with said movable base in shingle shearing opposition to said first bar, a given said bar having plural ones of said shearing edges extending lengthwise thereon, said plural shearing edges being circumferentially spaced on said given bar, said given bar having a plurality of alternate, end-for-end and circumferentially rotated, releasably fixable orientations with respect to the adjacent one of said support and movable base, said orientations respectively presenting different ones of said plural shearing edges in said shingle shearing opposition to the other of said bars;

at least one fastener releasably fixing said given bar with respect to said adjacent one of said support and base, said at least one fastener being symmetrically located along the length of said given bar and to therewith allow given bar reorientation and reaffixment in each of its end-for-end and circumferentially rotated orientations and thus with each of its said plural shearing edges presented for shingle shearing.

11. The apparatus of claim 10 in which said given bar is of rectangular cross section and has four sharp length edges alternately presentable for shearing, said given bar orientation being separated by 180° circumferential and end-for-end rotations to present all four of said sharp length edges, alternately for shearing and avoid cutter bar replacement when one of said length edges becomes dull.

12. The apparatus of claim 11 including plural ones of said fasteners, said plural fasteners being symmetrically located along the length of said given bar.

13. The apparatus of claim 12 in which said support and moveable base each carry a laterally spaced pair of said given bars, a fixed base, said shingle support protruding from said fixed base toward said movable base and being flanked by the corresponding said pair of given bars, said last mentioned given bars thereby protruding from said fixed base toward said movable base for shearing engagement by the pair of given bars on said moveable base.

* * * * *